US009580952B2

(12) United States Patent
Da Pont et al.

(10) Patent No.: US 9,580,952 B2
(45) Date of Patent: Feb. 28, 2017

(54) DEVICE FOR CLOSING THE DOOR OF A HOUSEHOLD APPLIANCE, IN PARTICULAR FOR A WASHING MACHINE, SUCH AS A DISHWASHER

(71) Applicant: ELBI International S.p.A., Turin (IT)

(72) Inventors: Paolo Da Pont, Collegno (IT); Michele Farano, Collegno (IT)

(73) Assignee: ELBI INTERNATIONAL S.P.A., Turin (IT)

( * ) Notice: Subject to any disclaimer, the term of this patent is extended or adjusted under 35 U.S.C. 154(b) by 88 days.

(21) Appl. No.: 14/378,587

(22) PCT Filed: Feb. 4, 2013

(86) PCT No.: PCT/IB2013/050939
§ 371 (c)(1),
(2) Date: Aug. 13, 2014

(87) PCT Pub. No.: WO2013/121318
PCT Pub. Date: Aug. 22, 2013

(65) Prior Publication Data

US 2015/0028734 A1 Jan. 29, 2015

(30) Foreign Application Priority Data

Feb. 13, 2012 (IT) ..... TO2012A0124

(51) Int. Cl.
*E05C 1/02* (2006.01)
*E05F 11/54* (2006.01)
(Continued)

(52) U.S. Cl.
CPC ..... *E05F 11/54* (2013.01); *A47B 96/00* (2013.01); *A47L 15/4259* (2013.01);
(Continued)

(58) Field of Classification Search
CPC ..... E05F 11/54; D06F 41/00; D06F 39/14; A47L 15/4261; A47L 15/4259;
(Continued)

(56) References Cited

U.S. PATENT DOCUMENTS 188,308 A * 3/1877 Sherman ..... E05B 55/00 292/1.5
2,765,648 A * 10/1956 Hatcher ..... E05B 47/00 292/144
(Continued)

FOREIGN PATENT DOCUMENTS

DE 44 20 775 8/1995
DE WO 2013150410 A1 * 10/2013 ..... D06F 37/42
(Continued)

OTHER PUBLICATIONS

International Search Report for International Application No. PCT/IB2013/050939 mailed May 6, 2013 (3 pages).

*Primary Examiner* — Kristina Fulton
*Assistant Examiner* — Faria Ahmad
(74) *Attorney, Agent, or Firm* — Merchant & Gould P.C.

(57) ABSTRACT

A dishwasher door closing device (10; 110) includes an engagement element (11; 111), fitted on the casing (C) of the household appliance (W) releasably held by a retaining element (16) on the door (D). The engagement element (11; 111) includes a support body (12), a catch (14) releasably coupled to the retaining element (16) moving between a refracted position coupled to the retaining element (16) and the door (D) is closed, and an extracted position coupled to the retaining element (16) and the door (D) is in a pre-opening condition. A stop mechanism (18) tends to move from a release condition, in which it (18) frees the catch (14) to move from the retracted position to the extracted position, to a locking position and (18) holds the catch (14). An
(Continued)

electrically-operated actuator system (20) controls passage of the stop mechanism (18) from the locking position to the release position.

9 Claims, 7 Drawing Sheets

(51) Int. Cl.

| | |
|---|---|
| ***A47L 15/42*** | (2006.01) |
| ***A47B 96/00*** | (2006.01) |
| ***D06F 39/14*** | (2006.01) |
| ***E05D 15/00*** | (2006.01) |
| ***E06B 3/38*** | (2006.01) |
| ***F25D 23/02*** | (2006.01) |
| *E05C 1/04* | (2006.01) |

(52) U.S. Cl.
CPC ..... *D06F 39/14* (2013.01); *E05D 15/00* (2013.01); *E06B 3/38* (2013.01); *F25D 23/028* (2013.01)

(58) Field of Classification Search
CPC ..... A47L 2401/26; A47L 15/4257; F25D 32/028; E05B 65/104; E05B 47/0009
USPC ..... 292/150, 151, 137, DIG. 69; 134/57 DL, 134/58 DL; 68/12.26; 126/191, 197
See application file for complete search history.

(56) References Cited

U.S. PATENT DOCUMENTS 3,857,002 A * 12/1974 Lay ..... D06F 37/42 134/58 DL
3,944,767 A * 3/1976 Rabuffetti ..... A47L 15/4259 134/58 DL
4,784,415 A * 11/1988 Malaval ..... E05B 47/00 292/144
4,951,693 A * 8/1990 Archambault ..... A47L 15/0034 134/57 DL
5,520,424 A * 5/1996 Hapke ..... D06F 37/42 292/198
5,630,631 A * 5/1997 Iwamoto ..... E05B 47/0607 292/150
5,682,772 A * 11/1997 Hapke ..... D06F 37/42 134/57 DL
5,937,880 A * 8/1999 Payzant ..... A47L 15/4206 134/175
6,048,001 A * 4/2000 Miller ..... E05B 1/0038 292/194
6,290,270 B1 * 9/2001 Spiessl ..... E05C 3/24 292/216
7,210,711 B2 * 5/2007 Dirnberger ..... A47L 15/4259 292/223
7,267,379 B2 * 9/2007 Rusiana ..... E05B 15/101 292/137
7,686,354 B2 * 3/2010 Jasper ..... E05B 47/0607 292/137
7,900,979 B2 * 3/2011 Bragg ..... A47L 15/4259 292/137
8,006,521 B2 * 8/2011 Rocchitelli ..... D06F 37/42 134/57 DL
8,025,349 B2 * 9/2011 Lim ..... E05B 17/0033 16/412
8,215,135 B2 * 7/2012 Hapke ..... D06F 37/42 134/57 DL
8,267,464 B2 * 9/2012 Konchan ..... B60J 5/0479 292/150
8,276,951 B2 * 10/2012 Dirnberger ..... A47L 15/4259 292/216
8,651,535 B2 * 2/2014 Oppel ..... 292/100
8,882,933 B2 * 11/2014 Assmann ..... A47L 15/4259 134/57 DL
9,107,560 B2 * 8/2015 Bauriedl ..... A47L 15/4259
2004/0163684 A1 * 8/2004 Hapke ..... A47L 15/4259 134/57 DL
2006/0283482 A1 * 12/2006 Berends ..... A47L 15/0034 134/18
2007/0144880 A1 * 6/2007 Bragg ..... A47L 15/4259 200/50.02
2007/0256715 A1 * 11/2007 Oppel ..... A47L 15/4259 134/57 DL
2009/0013733 A1 * 1/2009 Rocchitelli ..... D06F 37/42 70/160
2009/0072547 A1 * 3/2009 Dirnberger ..... A47L 15/4259 292/85
2011/0192430 A1 * 8/2011 Baldwin ..... E05B 17/0033 134/137
2012/0111366 A1 * 5/2012 Baldwin ..... A47L 15/4293 134/18
2014/0116097 A1 * 5/2014 Park ..... D06F 39/14 68/196

FOREIGN PATENT DOCUMENTS

EP 2 130 476 12/2009
EP 2 193 740 6/2010
IT EP 0917853 A1 * 5/1999 ..... A47L 15/4259
WO WO 2009/146874 12/2009
WO WO 2011/003714 1/2011
WO WO 2011/141542 11/2011

* cited by examiner

DEVICE FOR CLOSING THE DOOR OF A HOUSEHOLD APPLIANCE, IN PARTICULAR FOR A WASHING MACHINE, SUCH AS A DISHWASHER

This application is a National Stage Application of PCT/IB2013/050939, filed 4 Feb. 2013, which claims benefit of Ser. No. TO2012A000124, filed 13 Feb. 2012 in Italy and which applications are incorporated herein by reference. To the extent appropriate, a claim of priority is made to each of the above disclosed applications.

TECHNICAL FIELD

The present invention is relative to a device for closing the door of a household appliance, in particular for a washing machine, such as a dishwasher.

TECHNOLOGICAL BACKGROUND

In the field of household appliances, solutions have to be found, in order to allow an inner chamber obtained in a casing of said appliances, typically a washing chamber of a washing machine, such as a dishwasher, to be closed. To this regard, a door is used, which is mobile with respect to the casing so as to open and close an access opening, through which the inner chamber is able to communicate with the outside of the household appliance.

Generally, these devices comprise an engagement element, adapted to be fitted on either said casing or said door, and a retaining element, adapted to be fitted on the other one between the door and the casing. The retaining element is adapted to hold the engagement element in a releasable manner, so as to constrain the door to the casing, when the household appliance is being used.

Typically, the coupling between the engagement element and the retaining element takes place by means of the action of a user, who brings them closer by manually pushing the door against the casing, so as to obtain a complete closing. The decoupling between the engagement element and the retaining element takes place by means of the action of the user, who manually pulls the door away from the casing, if necessary by operating on suitable control interfaces (for example, provided on the front wall of the door or on the front or upper face of the casing), which activate inner mechanisms of the retaining element, which release the engagement element from the retaining element.

WO 2009/146874 discloses a dishwasher having a rinsing container that can be closed by a pivoting door, wherein to provide locking a locking device disposed on the door engages into a clamp disposed on the rinsing container, and wherein to open the door in gaps the clamp is disposed on an adjustable connecting rod that is adjustable in the opening direction by means of a drive. In order to also ensure the automatic retracting of the clamp when the electric gear motor is replaced with a more cost-effective drive, the invention provides means for returning the clamp at least approximately to the initial position thereof opposite to the opening direction as a result of the further opening movement of the door.

SUMMARY OF THE INVENTION

An object of the present invention is to provide a device for closing a door of a household appliance, which is improved and, at the same time, can be produced in a simple and economic fashion.

Another object of the present invention is to provide a device for closing a door of a household appliance, which is able to allow a pre-opening of the door in an automatic and safe manner, so as to establish a fluid communication between the washing chamber and the outside through the access opening. This solution is particularly advantageous in washing machines, for example dishwashers, since it allows the steam generated during the washing cycle to be let out, thus contributing to the at least partial drying of the articles contained in the washing chamber.

According to the present invention, this and other objects are reached by means of a device.

BRIEF DESCRIPTION OF THE DRAWINGS

Further features and advantages of the present invention will be best understood upon perusal of the following detailed description, which is provided by way of example and is not limiting, with reference to the accompanying drawings, which specifically show what follows.

FIGS from 4 to 6 are views that are similar to the one shown in FIG. 3, in which the device is represented in a sequence of different operating conditions.

DETAILED DESCRIPTION OF THE INVENTION

Figure 1:
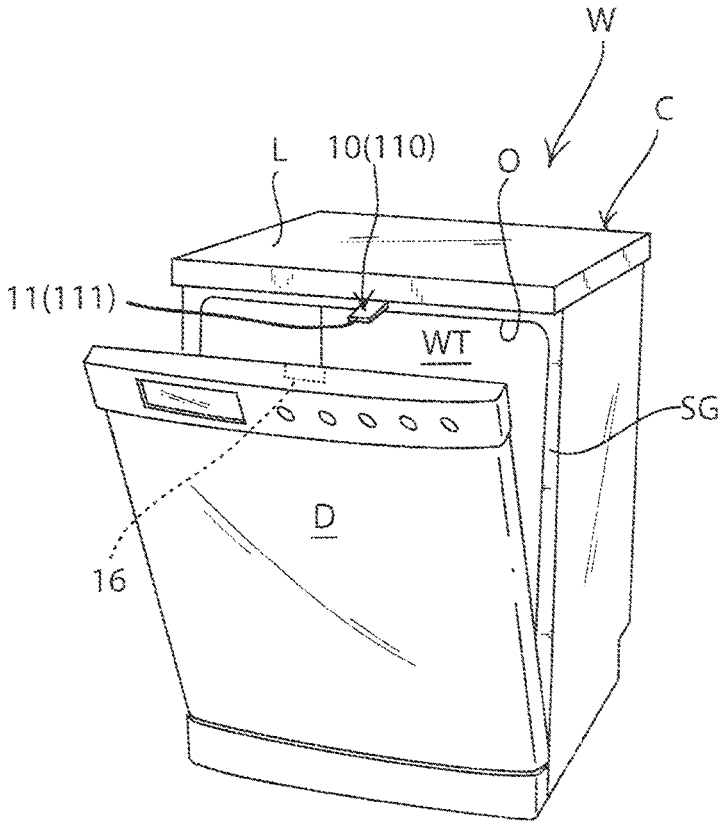
FIG. 1 is a prospective view of a dishwasher comprising a device for closing a door of a household appliance according to a first explanatory embodiment of the present invention.

With reference, in particular, to FIG. 1, W indicates, as a whole, an example of a washing machine, on which a first explanatory embodiment of a device 10 according to the present invention is adapted to be installed. Washing machine W is a dishwasher, though, as confirmed by the following description, device 10 can also be applied to different washing machines or to other household appliances.

With reference, in particular, to FIG. 1, dishwasher W presents a casing C, in which a washing tank or chamber WT is defined, which is adapted to receive the dishes to be washed. Washing tank WT presents an access opening O, through which washing tank WT communicates with the outside and which, therefore, is able to house the dishes. Furthermore, dishwasher W presents a door D, which is adapted to open (FIG. 1) and close access opening O (FIG. 2).

Access opening O is arranged on a front face of casing C and, preferably, the door is pivotable with respect to casing C, for example it is hinged along a horizontal axis that is arranged in the lower part of the latter. In the first embodiment shown, access opening O is peripherally provided with a sealing gasket SG, so as to allow washing tank WT to be closed in a fluid-tight manner, when door D is in a completely closed condition.

In the first embodiment shown, casing C presents a lid L, which is advantageously arranged on the top of said casing C.

Figure 2:
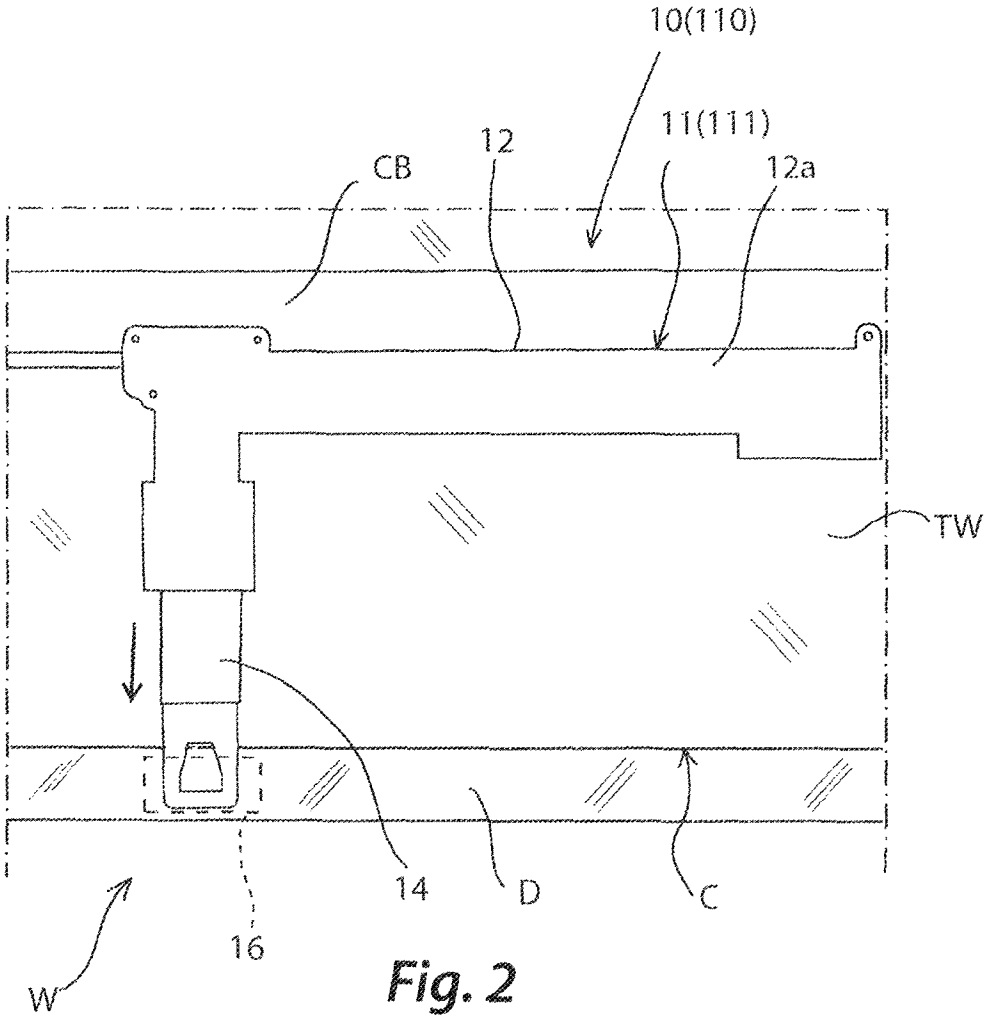
FIG. 2 is a partial schematic view, in particular a plan view from the top, of the dishwasher of FIG. 1, but without the lid and with the door in a complete close position.

In FIG. 2, washing machine W is shown without lid D and preferably presents a cross bar CB, which is arranged on a wall TW of washing tank WT. Preferably, lid D is arranged on the top of casing C.

With reference, in particular, to figures from 2 to 6, device 10 is adapted to allow door D of dishwasher W to be closed and comprises an engagement element 11, which is adapted to be fitted in correspondence to casing C, for example on cross bar CB arranged between casing C and lid L. Engagement element 11 is adapted to be held in a releasable manner by a retaining element 16, which is adapted to be fitted on door D, for example on its rear face facing access opening O.

Retaining element 16 is adapted to hold engagement element 11 in a releasable manner, so as to constrain door D to casing C, when washing machine W is being used. In the first embodiment shown, engagement element 11 is fitted on casing C, since the retaining element 16 is fitted on door D. Nevertheless, in further less preferred embodiments (not shown), the position of engagement element 11 with respect to retaining element 16 can be switched, namely by mounting engagement element 11 on door D when retaining element 16 is fitted to casing C.

Engagement element 11 comprises a support body 12, which, in the first embodiment shown, is fitted to casing C, and a catch 14, which is associated with support body 12 and is adapted to be coupled in a releasable manner to retaining element 16, which is fitted on door D, so as to constrain door D to casing C, when dishwasher W is being used. Preferably, catch 14 presents an oblong shape.

Figure 3:
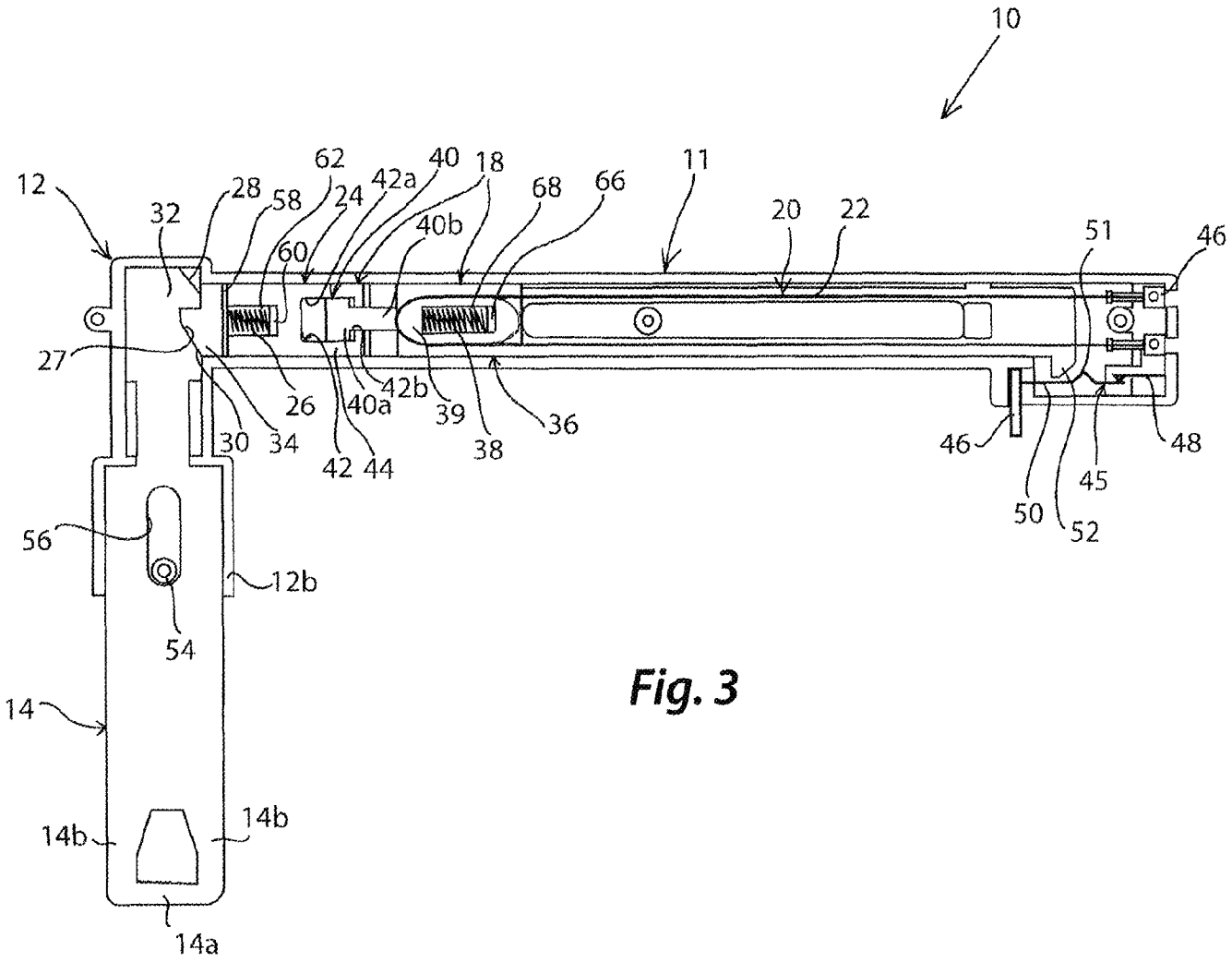
FIG. 3 is a view that is similar to the one shown in FIG. 2, in which the device is only partially represented.
Figure 4:
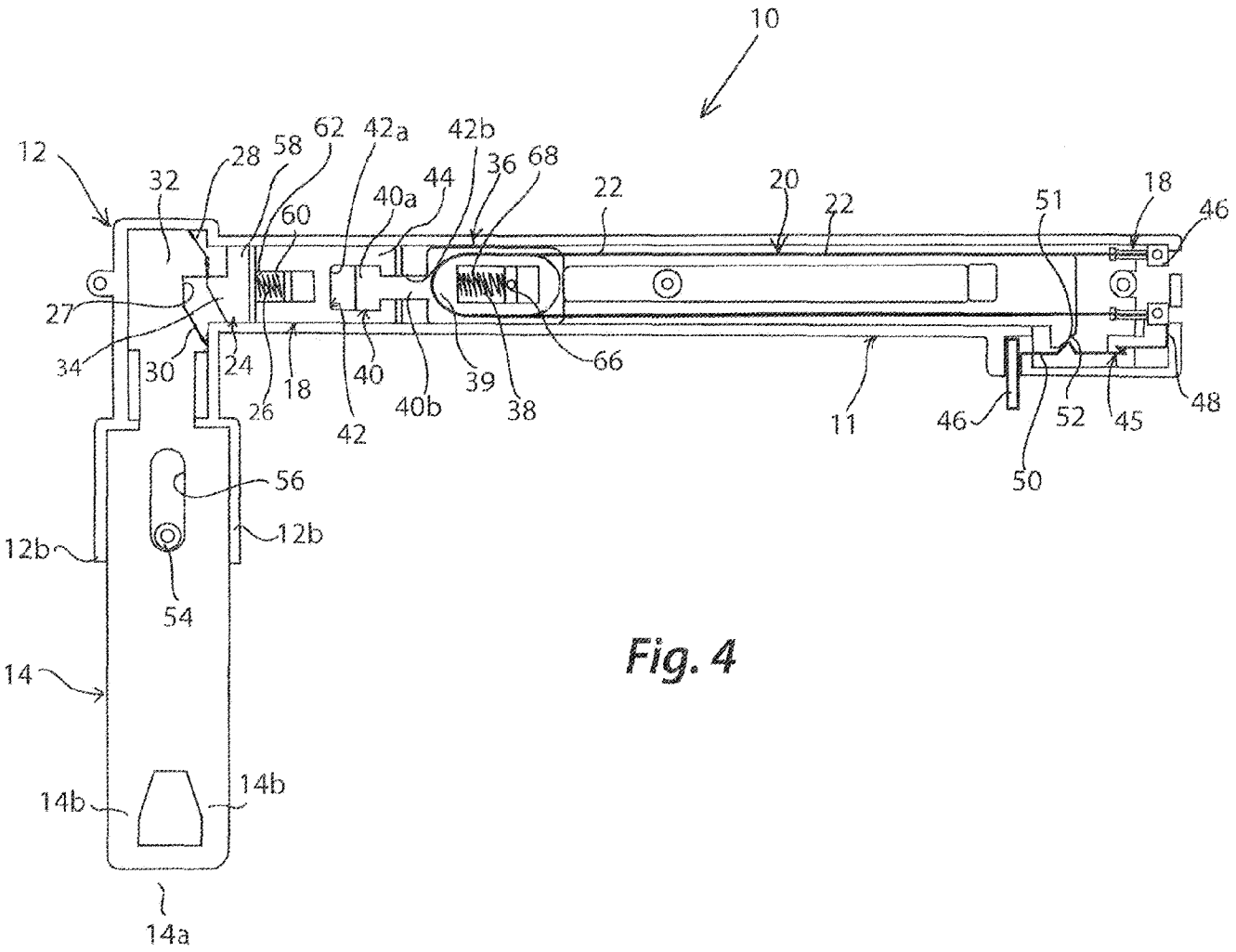
Figure 5:
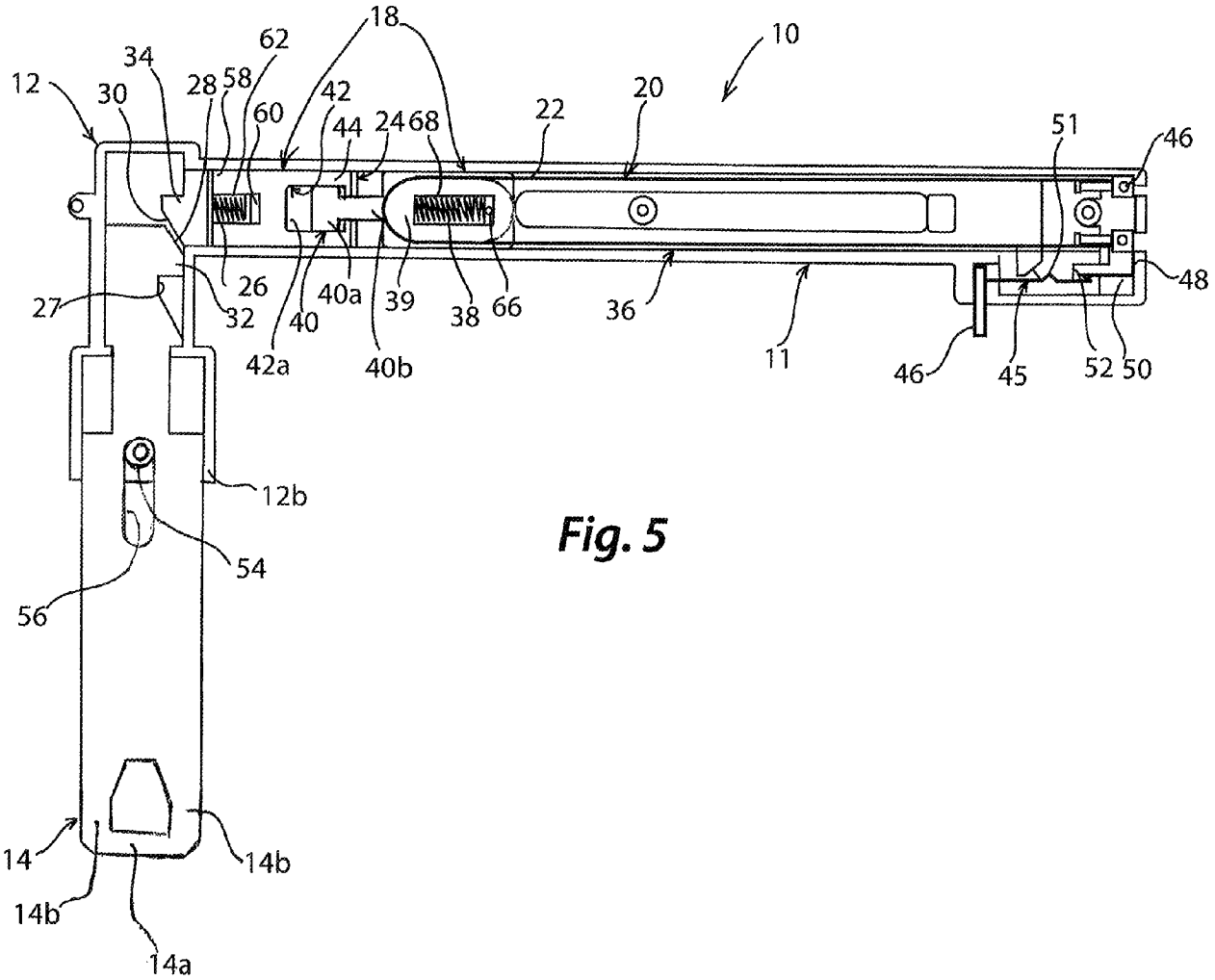

As explained in the description below, catch 14 is mounted so as to move with respect to support body 12 between a retracted position (FIGS. 3 and 4) and an extracted position (FIG. 5). In the first embodiment shown, in the retracted position, catch 14 partially projects from support body 12 with a section of its, whereas, in the extracted position, catch 14 further projects with an additional section. In particular, when catch 14 is coupled to retaining element 16 and moves to the extracted position, it pushes retaining element 16 away, which consequently causes door D to be pushed away, remaining at the same time constrained to casing C, though without being closed in a fluid-tight manner in correspondence to access opening O.

Retaining element 16 is substantially of a known type and presents, for example, a containing body, which is provided with a slit and houses a coupling mechanism, which can be accessed by catch 14 through said slid, so as to allow catch 14 itself to be coupled in a releasable manner to said coupling mechanism. Generally, said coupling mechanism is pivotable between an operating position and a rest position and comprises a rotatory organ, whose movement is opposed by an elastic organ and which is adapted be engaged in a releasable manner by catch 14. In the operating position, the rotatory member of the coupling mechanism holds catch 14 when door D is closed. On the other hand, in the rest position, the rotatory organ of the coupling mechanism allows catch 14 to be released when door D is manually opened by the user and, furthermore, allows catch 14 to be coupled in a releasable manner thereto when door D is manually closed by the user.

Examples of a retaining element 16 of the type described above are widely known in the technical field and are described in detail in many prior art documents. In order to provide a complete information, Italian patent applications no. TO97A1120, TO2000A000383 and TO2001A01003 are cited. Therefore, for sake of brevity, retaining element 16 will not be further described in the description below.

When catch 14 is coupled to retaining element 16 and is arranged in its retracted position, engagement element 11 is in the arrangement shown in FIG. 2, in which door D is in a complete closing condition, thus closing access opening O of washing chamber WT in a fluid-tight manner. On the other hand, when the catch is coupled to retaining element 16, but is arranged in its extracted position, door D assumes a pre-opening condition, thus being slightly apart from access opening O of casing C, so as to establish a fluid communication between washing chamber WT and the outside of said casing C. In particular, in the pre-opening condition, the steam contained in washing tank WT (which, for example, is generated during a washing cycle of dishwasher W) is allowed to flow out of dishwasher W, so as to allow the dishes contained therein to be at least partially dried.

In other words, when catch 14 is coupled to retaining element 16 and moves to the extracted position, it pushes retaining element 16 away from support body 12, which consequently causes door D to be moved away from casing C. Though, due to the coupling between catch 14 and retaining element 16, door D remains in any case constrained to casing C, though without closing access opening O in a fluid-tight manner.

Engagement element 11 comprises, furthermore, a stop mechanism, which is indicated, as a whole, with number 18 and cooperates with catch 14. Stop mechanism 18 is prone to pass from a release condition (FIG. 4), in which it sets catch 14 free, thus allowing it to move from the retracted position to the extracted position, to a locking condition (FIG. 3), in which it holds catch 14 when the latter is arranged in its retracted position. In the first embodiment shown, when door D is in the complete closing condition, the movement from the retracted position to extracted position of catch 14 is facilitated by the weight of door D (which is connected to catch 14 by means of the coupling to retaining element 16) and—in case—by the elastic compression load provided by sealing gasket SG compressed between door D and casing C. Indeed, as soon as stop mechanism 18 assumes the release condition, door D tends to slightly fall towards the outside of casing C due to the weight of door D and to the elastic load of sealing gasket SG, until catch 14 reaches the extracted position, in which door D stops in the pre-opening condition.

Furthermore, the first support body 12 comprises an electrically-operated actuator 20, which is adapted to control the movement of stop mechanism 18 from the locking condition to the release condition. By way of example, this movement is performed when actuator 20 is excited by the passage of an electric current. In the first embodiment shown, actuator 20 is connected to an outer control unit associated with household appliance W and is able to supply an electric current to actuator 20 in predetermined operating conditions.

Preferably, actuator 20 is adapted to pass from a normally extended condition (FIGS. 3, 5, and 6) to a contracted condition (FIG. 4). In the extended condition, actuator 20 allows stop mechanism 18 to assume the locking position, whereas, in the contracted position, actuator 20 brings stop mechanism 18 to said release position.

More preferably, actuator 20 comprises a shape-memory conductor element 22, which is mechanically connected to and cooperates with stop mechanism 18. In particular, conductor element 22 is made of a shape memory alloy (SMA), which is able to assume a predetermined shape (in this case, corresponding to the one assumed in the contracted condition) following a variation of the due temperature, in the first embodiment, due to the Joule heating caused by the passage of current through it.

In alternative embodiments, which are not shown, conductor element 22 can be replaced by different types of electric actuators; in these embodiments, the actuator can comprise an electromagnetic actuator (e.g. of the solenoid type) or an electrothermal actuator (e.g. of the wax type). The above-mentioned types of actuators are known in the technical field and, therefore, for the sake of brevity, they will not be described hereinafter.

As described more in detail below, in the first embodiment shown, conductor element 22 presents the shape of a wire, which is mechanically connected to—and acts on—stop mechanism 18, so as to move the latter from the normal locking condition to the release condition.

In the first embodiment shown, stop mechanism 18 comprises a slider 24, which is mounted so as to move—in particular to slide—with respect to support body 12 from a locking position (FIGS. 3, 5 and 6) to a release position (FIG. 4). In the locking position, slider 24 is adapted to hold catch 14 when the latter is arranged in its retracted position, thus preventing it from moving to the respective extracted position. On the other hand, in the release position, slider 24 allows catch 14 to move from the retracted position to the extracted position due to an electric excitation of actuator 20. Furthermore, stop mechanism 18 comprises an elastic member 26, which is prone to hold slider 24 in the locking position. In the first embodiment shown, elastic member 26 is interposed between support body 12 and slider 24. Preferably, elastic member 26 is a spring, for example a compression-preloaded spring, advantageously of the helical type.

Preferably, slider 24 is inserted in a recess 27, which is laterally obtained on catch 14, when slider 24 and catch 14 are arranged in the locking position and in the retracted position respectively. Therefore, in the embodiment shown, stop mechanism 18 substantially has the properties of a ratchet gear, in which slider 24 acts a ratchet, which is adapted to prevent catch 14 from moving. In particular, when engagement element 11 and retaining element 16 are coupled to one another, catch 14 is subject to pull forces, which are due to the weight of door D and, in case, to the elastic compression of sealing gasket SG and correspondingly stress slider 24.

Slider 24 and catch 14 preferably present respective complementary profiles 28 and 30, which cooperate with one another. Profiles 28 and 30 are adapted to allow, by means of interference, the forced movement of catch 14 from the extracted position to the retracted position against the action of elastic member 26. In the first embodiment shown, profiles 28 and 29 are respective inclined sections of projecting noses 32 and 34, which are supported by slider 24 and catch 14 respectively. The cooperation between profiles 28 and 30 will be described in detail below, together with the overall operation of device 10.

In the first embodiment shown, stop mechanism 18 comprises, furthermore, a cursor 36, which can be moved—in particular can slide—by means of actuator 20, with respect to support body 12, from an inactive position (FIGS. 3, 5 and 6) to an active position (FIG. 4). In the inactive position, cursor 36 allows slider 24 to move from the release position to the locking position due to the action of elastic member 26. On the other hand, in the active position, cursor 36 drags slider 24 from the locking position to the release position against the action of elastic organ 26, when actuator 20 is electrically excited. Furthermore, stop mechanism 18 comprises an elastic element 38, which is prone to hold cursor 36 in the locking position. In the first embodiment shown, elastic element 38 is interposed between support body 12 and cursor 36. Preferably, elastic element 38 is a spring, for example a compression-preloaded spring, advantageously of the helical type.

Preferably, cursor 36 is mechanically connected to shape-memory element 22 and, therefore, is adapted to be dragged by the latter between the locking position and the release condition. In the first embodiment shown, shape-memory element 22 is configured as a conductor wire 22, which is connected to cursor 36 and, for example, is arranged in a U-shape so as to surround part of cursor 36 with its loop. Preferably, this conductor wire 22 is wound with its loop along a peripheral section of a protuberant portion 39 of cursor 36, for example by being inserted into a perimetral groove (not numbered) obtained in said peripheral section.

In the first embodiment shown, slider 24 and cursor 36 are coupled with a sliding clearance. Preferably, the coupling between slider 24 and the cursor substantially is of the so-called "coulisse" type. More preferably, cursor 36 presents a mushroom-shaped end 40 and slider 24 presents a shaped cavity 42, which houses the mushroom-shaped end with an axial clearance. Even more preferably, mushroom-shaped end 40 presents a transversely wide head **40*a* and a narrow neck 40*b* transversely tapering from head 40*a*; cavity 42 presents, in turn, a transversely wide proximal portion 42*a*, which houses head 40*a* with an axial clearance, and a transversely narrow distal portion 42*b*, which starts from proximal portion 42*a* and allows neck 40*b* to axially slide through it. Advantageously, shaped cavity 42 is defined by a pair of lateral arms 44, which are arranged at the end of slider 24 and transversely converge inwards in correspondence to their free ends. By way of example, each one of lateral arms 44** substantially defines the shape of a hook.

In the first embodiment shown, elastic element 38 exerts a returning elastic force on cursor 36, which is higher than the returning elastic force exerted by elastic member 26 on slider 24. In this way, elastic member 38 is able to effectively cause cursor 36 to return to its active position, in particular by causing conductor wire 22 to return in a reliable manner and with a high intensity force. Furthermore, in this way, elastic member 36 is able to move slider 24 back to its locking position, without for this reason causing the action of a user who forcedly moves slider 14 back to it retracted position, by pushing door D to the complete closing position, to be uncomfortable due to an exaggerated resistance.

In the first embodiment shown, slider 24 and/or cursor 36 can be moved in a direction that is substantially transverse, and preferably orthogonal, to the movement direction of catch 14. By way of example, slider 24 and cursor 36 can be moved in the same direction.

Preferably, stop mechanism 18 is adapted to interrupt the electric excitation of actuator 20 after stop mechanism 18 has taken on the locking condition. More preferably, actuator 20 comprises a safety switch 45, which is controlled by stop mechanism 18 and is adapted to electrically disconnect actuator 20 from the outer control unit, when the stop mechanism reaches the release condition. In the first embodiment shown, switch 45 is electrically connected downstream of one of supply contacts 46, which allow actuator 20 to be connected to the outer control unit. By way of example, supply contacts 46 are electrically connected to the ends of conductor wire 22.

Preferably, switch 45 comprises a stationary contact 48 and a mobile contact 50, which cooperates with stop mechanism 18, so as to be moved away from the stationary contact 48 when stop mechanism 18 reaches the release condition. In the first embodiment shown, mobile contact 50 presents a shaped projection 51, which is adapted to come into contact with a corresponding projection 52 supported by stop mechanism 18, for example by cursor 36, so that mobile contact 50 moves away, for example by bending, from stationary contact 48, when stop mechanism 18 reaches the release condition, for example when cursor 36 reaches the active position. Preferably, shaped projection 51 of mobile contact 50 presents a spire-shaped profile. Preferably, projection 52 has the shape of an inclined section, which substantially matches the section of the spire-shaped profile offered by mobile contact 50.

Before describing the way in which device 10 operates, we would like to mention, in the following description and in a non exhaustive manner, some further advantageous features of engagement element 11.

Support body 12 is shaped as a casing that houses, on the inside, a part of catch 14, stop mechanism 18 and actuator 20.

Support body 12 comprises a pair of half-shells 12*a*, 12*b*, for example a pair of cups, which are coupled to one another in an interlocking manner in correspondence to their periphery.

In the first embodiment shown, support body 12 is manufactured with a plastic material, for example by means of injection molding.

Support body 12 is screwed to casing C of household appliance W, for example in correspondence to cross bar CB.

Catch 14 can slide in support body 12 and in doing so is preferably guided by the inner walls of support body 12, for example by lateral walls of lower half-shell 12*b* and by the bottom walls of both half-shells 12*a*, 12*b*.

The movement of catch 14 in support body 12 from the extracted position to the retracted position is delimited by a limit stop element 54, for example a pin, which is fitted in a stationary manner to support body 12 and is housed in a slot 56 obtained in catch 14. Limit stop element 54 is adapted to strike against the end edges of slot 56 when catch 14 reaches the extracted position and, in case, the retracted position.

Catch 14 is manufactured with a plastic material, for example by means of injection molding.

The end of catch 14 that is adapted to be coupled to engagement element 16 presents a transverse hook or rod 14*a*, which is supported by at least one support appendage 14*b* axially extending from the rest of catch 14. Preferably, support appendage 14*b* ends in correspondence to a lateral end of transverse hook or rod 14*a*. In this first embodiment, transverse hook 14*a* is supported, in correspondence to its laterally opposite ends, by a pair of support appendages 14*b*, which are transversely spaced apart.

Slider 24 can slide in support body 12 and in doing so is preferably guided by the inner walls of support body 12, for example by lateral walls of lower half-shell 12*b* and by the bottom walls of both half-shells 12*a*, 12*b*.

Slider 24 is manufactured with a plastic material, for example by means of injection molding.

Elastic member 26 is axially interposed between a projecting overhang 58 of slider 24 and a stationary bracket 60 projecting from support body 12, for example from the lower half-shell 12*b* Preferably, bracket 60 is housed in correspondence to a guide opening 62, which is obtained through slider 24. In this way, elastic member 26 is able to push overhang 58, which is integral to slider 24, until an end edge of guide opening 62 comes into contact with stationary bracket 60, which corresponds to the locking position of slider 24. Therefore, stationary bracket 60 also acts as a limit stop for slider 24.

Cursor 36 can slide in support body 12 and in doing so is preferably guided by the inner walls of support body 12, for example by walls of lower half-shell 12*b* and by the bottom walls of both half-shells 12*a* and 12*b*.

Elastic element 38 is axially interposed between a further overhang (e.g. protuberant portion 39) projecting from cursor 36 and a further stationary bracket 66 projecting from support body 12, for example from lower half-shell 12*b* Preferably, further bracket 66 is housed in correspondence to a further guide opening 68, which is obtained through cursor 36, for example close to the further overhang (in the first embodiment shown, through protuberant portion 39). In this way, elastic element 38 is able to push further overhang 39, which is integral to cursor 36, until an end edge of further guide opening 68 comes into contact with further stationary bracket 66, which corresponds to the inactive position of cursor 36. Therefore, further stationary bracket 66 also acts as a limit stop for the cursor.

The operating mode of the embodiment shown of device 10 according to the present invention will be described below.

First of all, one should consider the configuration of dishwasher W with door D partially open (FIG. 1).

In this configuration, engagement element 11 presents catch 14 in the extracted position, stop mechanism 18 in the locking condition, and actuator 20 is electrically unexcited (FIG. 5). More in detail, slider 24 is held in the locking position by elastic member 26, while cursor 36 is held in the inactive position by elastic element 38. Furthermore, conductor wire 22 is in the extended condition and is subject to a pull force.

In this situation, door D, with engagement element 11 decoupled from retaining element 16, can be completely opened by a user and, therefore, the dishes to be washed can be introduced into washing chamber WT. Subsequently, the user can choose the washing cycle to be performed by dishwasher W by acting on proper control interfaces that are typically available on door D.

Afterwards, the user closes door D towards casing C, thus moving retaining element 16 closer to catch 14 of engagement element 10, so as to cause them to be coupled to one another, in order to automatically start the washing cycle of dishwasher W.

Figure 6:
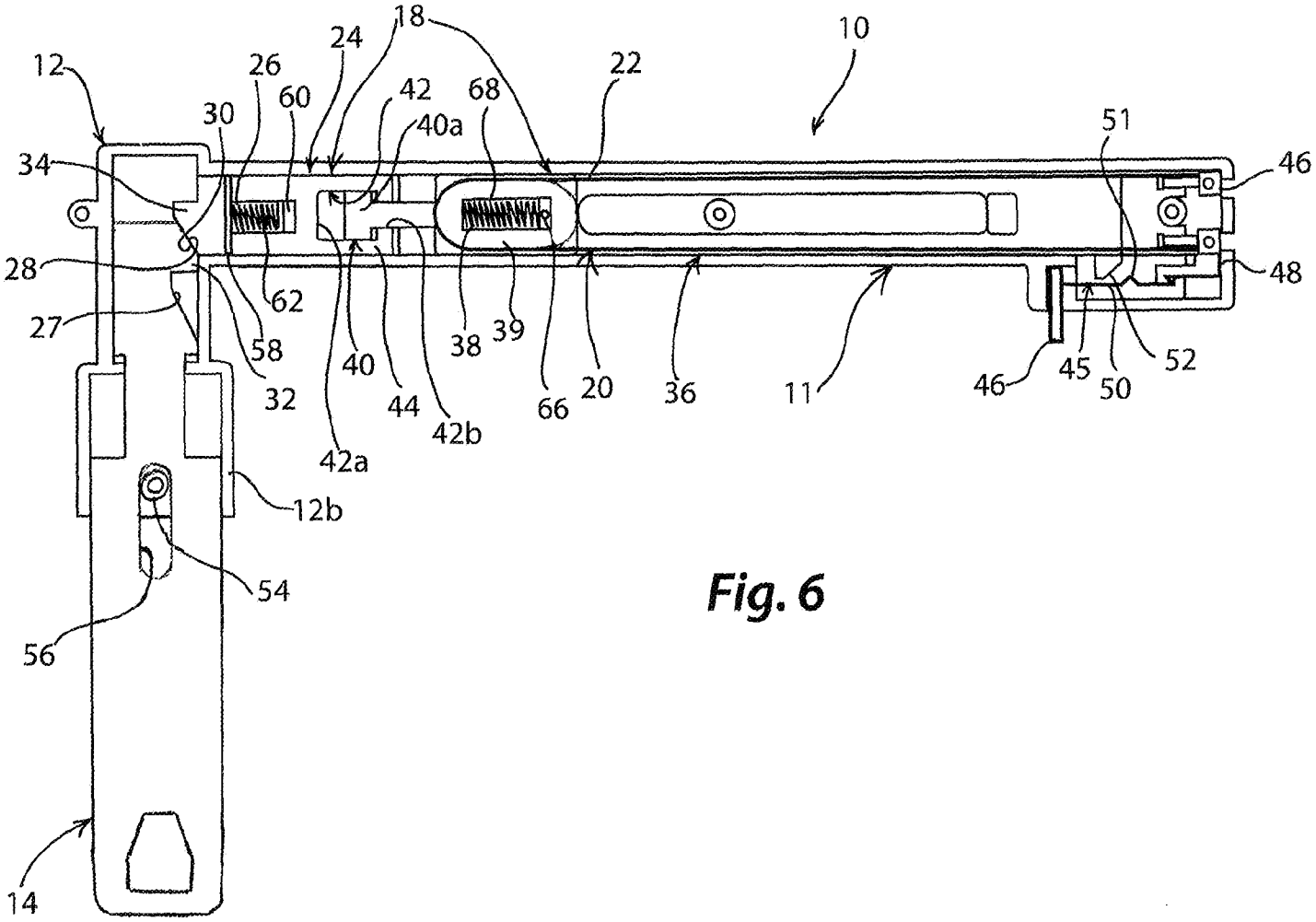

The thrust exerted by the user to completely close door D causes the profile of catch 14 to hit against profile 30 of slider 24, so as to generate a thrust that is transverse with respect to catch 14 and, in turn, axially moves slider 24 backwards against the action of elastic member 28 (FIG. 6). When profile 28 of catch 14 moves past profile 30 of slider 24, catch 14 cannot exert said transverse thrust any longer and, therefore, elastic member 26 brings slider 24 back to the locking position, in particular by causing it to be inserted into recess 27 of catch 14, for example with nose 34 (FIG. 3).

During the cooperation between profiles 28 and 30, the backward movement of slider 24 does not interfere with the position of cursor 36 and elastic element 38, as a consequence, is not stressed, in particular thanks to the sliding coupling with clearance between the two of them. More in detail, proximal portion 42*a* of cavity 42 moves relative to head 40*a* of mushroom-shaped end 40 without them hitting against one another.

After the above-mentioned closing operation has been performed by the user, dishwasher W presents door D completely closed and engagement element 11 is arranged in the configuration shown in FIGS. 2 and 3 and is coupled to retaining element 16. Therefore, the washing cycle chosen by the user can be automatically started by the outer control unit of dishwasher W.

In this configuration, engagement element 11 presents catch 14 in the retracted position, stop mechanism 18 in the locking condition, and actuator 20 is electrically unexcited. More in detail, slider 24 is held in the locking position by elastic member 26, while cursor 36 is held in the inactive position by elastic element 38. Furthermore, conductor wire 22 is in the extended and stretched condition.

At the end of the above-mentioned washing cycle performed by washing machine W, the outer control unit provides actuator 20 with a current impulse, so as to electrically excite actuator 20 itself and, therefore, move stop mechanism 18 to the locking condition.

The passage of electric current causes conductor wire 22 to heat up and to rapidly pass from the extended condition to the contracted condition, thus becoming shorter and dragging cursor 36 backwards from the inactive position to the active position against the action of elastic element 38 (FIG. 4). Therefore, after a short loadless travel (for example, approximately a half millimeter long), cursor 36 drags slider 24 from the locking position to the release position. More in detail, mushroom-shaped end 40 comes into contact with the converging ends of lateral arms 44 and, in this way, causes slider 24 to be dragged backwards.

In the first embodiment shown, conductor wire 22 is designed to reduce its length by approximately 3.5% during the passage from the extended and stretched condition to the contracted and shortened condition.

In this way, catch 14 is free to move to the extracted position (FIG. 5) due to the connection with retaining element 16, which is supported by door D. Indeed, the reaction of sealing gasket SG fitted around access opening O, which is due to the elastic compression preloading, pushes door D away from casing C. When catch 14 is in the extracted position, limit stop element 54 hits against an end of slot 56, thus avoiding a possible undesired overtravel.

Preferably, catch 14 is designed, when it is arranged in the extracted position, to further project from support body 12 with a length of some centimeters, for example with a length comprised between 1 cm and 3 cm, with respect to the normal projection that catch 14 assumes when it is arranged in the retracted position; in this way, the distance between door D and access opening O corresponds to the length mentioned above, which is sufficient to allow a fluid communication between washing chamber WT and the outside of casing C. In the first embodiment shown, said length is equal to 1.5 cm.

At the end of the electric current impulse provided by outer control unit, actuator 20 goes back to the electrically unexcited condition and stop mechanism 18 returns to the locking condition.

During this step, when the electric current impulse has ended, conductor wire 22 starts cooling down and gradually returns to the extended condition, thus becoming longer, and elastic element 38 correspondingly and progressively pushes cursor 36 forward towards the inactive position following the loop of conductor wire 22, which is extended; in particular, mushroom-shaped end 40 of elastic element 38 gradually moves forward towards the inactive position following the stretching out of conductor wire 22. Consequently, lateral arms 44 of slider 24, which had been previously dragged backwards by cursor 36, tend to follow the forward movement of mushroom-shaped head 40 due to elastic member 26 and cause slider 24 to gradually move back to the locking position.

In the first embodiment shown, elastic element 38 has an elastic compression preload of approximately 0.5 kg and conductor wire 22 has a diameter of approximately 0.38 mm. The preload of elastic element 38 is adjusted as a function of the diameter of conductor wire 22, so that cursor 36 can actually be brought back to the inactive position.

In the first embodiment shown, elastic organ 26 has an elastic compression preload of approximately 200 g, which is lower than the one of the elastic element. As a matter of fact, elastic organ 26 fulfills the main function of preventing slider 24 from correctly repositioning itself in the locking position, in particular in case the returning action of elastic element 38, which is adapted to cause the return of conductor wire 22, is affected by accidental jamming or seizing.

In the first embodiment shown, conductor wire 22 is designed to cool down and go back from the contracted and shortened position to the extended and stretched condition over a time of approximately 13 s.

Expediently, when stop mechanism 18 reaches the release condition, it interrupts the electric connection between the outer control unit and actuator 20. This measure is adopted in order to prevent conductor wire 22 from being damaged due to an excessive overheating caused by a possible accidentally and anomalously prolonged duration of the excitation current impulse provided by the outer control unit (provoked, for example, by a failed interruption of the nominal operating times). More in detail, when cursor 36 reaches the active position, it interferes with safety switch 45, thus opening it and interrupting the passage of current through conductor wire 22. In particular, projection 52 of cursor 36 hits against shaped projection 51 of mobile contact 50 of switch 45, thus moving it away from stationary contact 48 associated therewith.

When stop mechanism 18 returns to the locking position and catch 14 has moved to the extracted position (FIG. 5), door D is in the pre-opening condition, in which it is sufficiently spaced apart from access opening O to allow the fluid communication between washing chamber WT and the outside to be established. The distance between door D and access opening O allows the steam generated during a washing cycle of dishwasher W to flow out and, therefore, allows the dishes contained in washing chamber WT to be dried. Furthermore, during this step, complementary profiles 28 and 30 face each other again.

At the end of the overall operating cycle of the dishwasher, the user can decouple door D from casing C by pulling door D towards him/her when retaining element 16 is arranged in its rest position. This is how retaining element 16 is decoupled from catch 14 of engagement element 11.

At the end of the overall operating cycle of the dishwasher, the user can decouple door D from casing C by pulling door D towards him/her when retaining element 16 is arranged in its rest position. This is how retaining element 16 is decoupled from striker 14 of engagement element 11.

Now door D can be completely opened and the dishes that have been washed—and at least partially dried—can be removed by the user.

Afterwards, dishwasher W can be loaded again in order to perform a new washing cycle, substantially repeating from the beginning the operating mode described above.

In the first embodiment shown, the cooperation between slider 24 and cursor 36 presents the advantage of preventing conductor wire 22, during the forced movement of catch 14 from the extracted position to the retracted position generated by a user who completely closes door D, from temporarily releasing stop mechanism 18, thus causing a failure or a damage of device 10. Indeed, when catch 14 is pushed from the extracted position to the refracted position, slider 24 can freely move from the locking position to the release position against the action of elastic member 26 without interfering with cursor 36, in particular thanks to the sliding clearance that is advantageously obtained between mushroom-shaped head 40 and lateral arms 44. In this way, cursor 36 is not moved backwards and does not release the tension of conductor wire 22, which, instead, always remains subject to a pull force.

Figure 7:
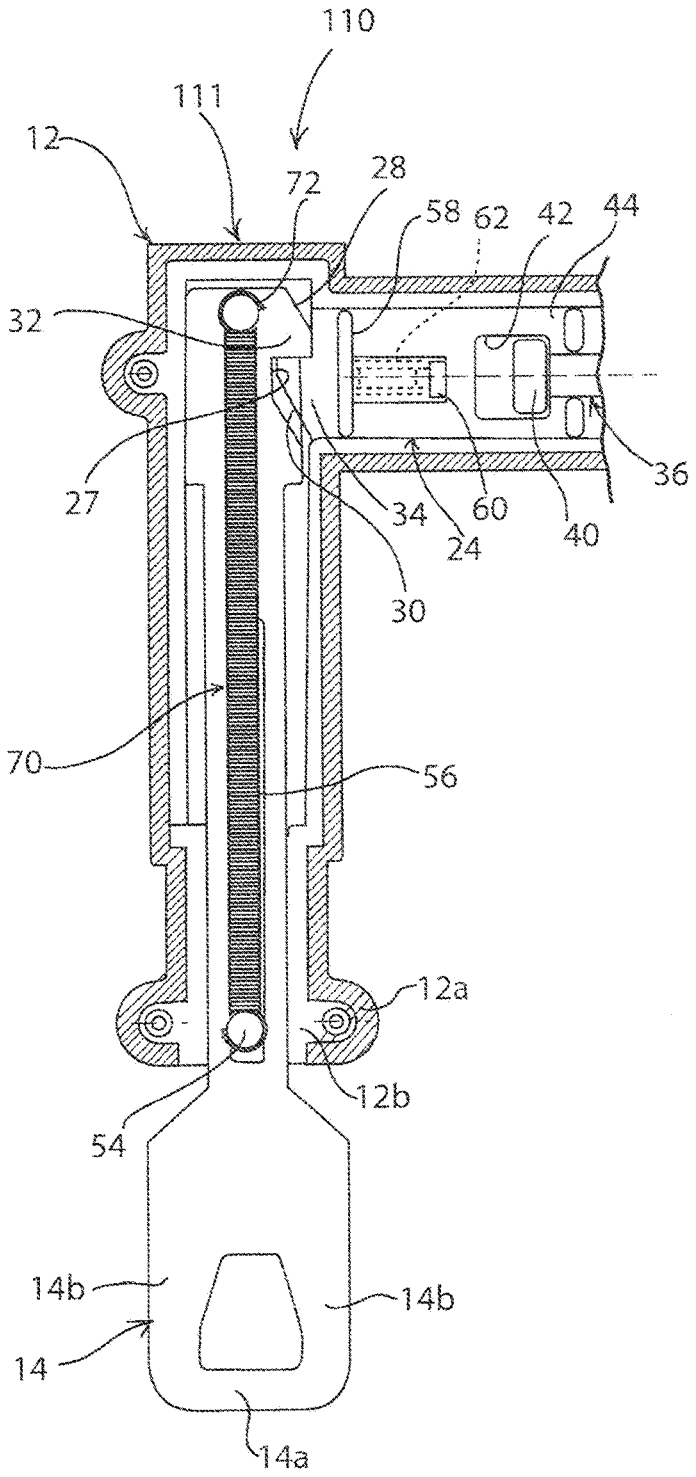
FIG. 7 is a plan view from the top, which is similar to the ones shown in figures from 3 to 6, but shows a device according to a second explanatory embodiment of the present invention.

FIG. 7 shows a device 110, which is manufactured according to a second embodiment of the present invention.

Said device 110 is substantially similar to device 10 manufactured according to the first embodiment of the present invention. Therefore, details and elements that are similar to those of the embodiment described above or fulfill a similar function are associated to the same alphanumeric references. For the sake of brevity, the description of these details and elements will not be repeated below, but reference is made to what was previously explained in the description of the first embodiment.

In the second embodiment, unlike in the first embodiment, the engagement element, which is indicated, as a whole, with number 111, presents an elastic return member 70, which is prone to move catch 14 from the retracted position to the extracted position. In this second embodiment, elastic return member 70 is a pull-loaded spring, for example of the helical type, which tends to pull catch 14 towards the extracted position, when stop mechanism 18 is arranged in the release position.

Preferably, elastic return member 70 is interposed between body 12, for example half-shell 12*a*, and catch 14. More preferably, elastic return member 70 is fitted between catch 14 and limit stop element 54.

Advantageously but not necessarily, the elastic return member 70 is fitted between a pin 72, which is integral to catch 14, and another pin, which is supported by body 12, for example by half-shell 12*a*. Preferably, the other pin is limit stop element 54. In the second embodiment, elastic return member 70 presents an end that is coupled to pin 72 and another end that is coupled to the other pin or limit stop element 54. In particular, pin 72 is arranged on the opposite side with respect to the end of catch 14 that is adapted to be coupled to retaining element 16.

The use of elastic return member 70 in engagement element 11 helps door D move from the complete closing position to the pre-opening position, slightly moving away from access opening O. At the same time, this measure hinders possible accidental actions that may close the door, for example when the user unintentionally leans against the door.

If possible, the technical features differentiating the different versions of the embodiments described and illustrated above can freely be exchanged between said versions and embodiments.

Naturally, the principle of the present invention being set forth, the embodiments and the implementation details can be widely changed with respect to what described above and shown in the drawings as a mere way of non-limiting example, without in this way going beyond the scope of protection provided by the accompanying claims.

By way of example, in less preferred embodiments, a stop mechanism can be used, which presents only the slider and the elastic member associated therewith, thus without the cursor and the elastic element associated therewith. In this configuration, the actuator is adapted to directly cooperate with the slider, for example by winding the conductor wire around the latter.

The invention claimed is:

1. A device for closing a door of a household appliance; said door being adapted to close an inner chamber, which is in a casing of said household appliance and communicates with outside through an access opening; said device comprising:

an engagement element, adapted to be fitted on either said casing or said door and adapted to be held in a releasable manner by a retaining element, adapted to be fitted on the other of said door and said casing, so as to constrain said door to said casing, when using said household appliance; the engagement element comprising:

a support body, adapted to be fitted on one of said casing and said door;

a catch, adapted to be coupled in a releasable manner to said retaining element, and is mounted so as to move, with respect to said support body, between a retracted position, in which said catch is coupled to said retaining element and said door is in a completely closed condition, thus closing said access opening in a fluid-tight manner, and an extracted position, in which said catch is coupled to said retaining element and said door is in a pre-opening condition, thus being arranged at a distance from said access opening, so as to establish a fluid communication between said inner chamber and the outside of said casing;

a stop mechanism, which cooperates with the catch and is configured to pass from a release condition, in which the stop mechanism is adapted to set said catch free, allowing said catch to move from the retracted position to the extracted position, to a locking position, in which said stop mechanism is adapted to hold said catch in said retracted position; and electrically-operated actuating means for controlling passage of said stop mechanism from said locking position to said release position;

a slider, which is mounted so as to move, with respect to said support body, from a locking position, in which said slider is adapted to hold said catch in said retracted position, to a release position, in which said slider allows movement of said catch from said retracted position to said extracted position, due to an electrical excitation of said actuating means;

an elastic member tending to hold said slider in said locking position;

a cursor, which can be moved by said actuating means and is mounted so as to move, with respect to said support body, from an inactive position, in which said cursor allows the passage of said slider from said release position to said locking position due to the action of said elastic member, to an active position, in which drags said slider from said locking position to said release position against action of said elastic member, when said actuating means are electrically excited; and an elastic element, which holds said cursor in said inactive position.

2. The device according to claim 1, wherein said actuating means are configured to be excited by a passage of electric current.

3. The device according to claim 1, wherein said actuating means are adapted to pass from a normally extended condition, in which the actuating means allow said stop mechanism to assume said locking position, to a contracted condition, in which the actuating means take said stop mechanism to said release position.

4. The device according to claim 3, wherein said actuating means comprise a shape-memory conductor element, which is mechanically connected to and cooperates with said stop mechanism.

5. The device according to claim 1, wherein said slider and said cursor are coupled with a sliding clearance.

6. The device according to claim 1, wherein said elastic element exerts a returning elastic force on said cursor, which is higher than a returning elastic force exerted by said elastic member on said slider.

7. The device according to claim 1, wherein said slider and/or said cursor can be moved in a direction that is orthogonal, to a direction of movement of said catch.

8. The device according to claim 1, wherein said engagement element comprises a return elastic member, which takes said catch from said retracted position to said extracted position.

9. Household appliance comprising:

a casing presenting an inner chamber, which has an access opening, through which said inner chamber can communicate with the outside of said casing;

a door, adapted to close said access opening; and a device for closing a door of a household appliance; said door being adapted to close an inner chamber, which is in a casing of said household appliance and communicates with outside through an access opening; said device comprising:

an engagement element adapted to be fitted on either said casing or said door and adapted to be held in a releasable manner by a retaining element, adapted to be fitted on the other of said door and said casing, so as to constrain said door to said casing, when using said household appliance; the engagement element comprising:

a support body adapted to be fitted on one of said casing and said door;

a catch, adapted to be coupled in a releasable manner to said retaining element, and is mounted so as to move, with respect to said support body, between a retracted position, in which said catch is coupled to said retaining element and said door is in a completely closed condition, thus closing said access opening in a fluid-tight manner, and an extracted position, in which said catch is coupled to said retaining element and said door is in a pre-opening condition, thus being arranged at a distance from said access opening, so as to establish a fluid communication between said inner chamber and the outside of said casing;

a stop mechanism, which cooperates with the catch and is configured to pass from a release condition, in which the stop mechanism is adapted to set said catch free, allowing said catch to move from the retracted position to the extracted position, to a locking position, in which said stop mechanism is adapted to hold said catch in said retracted position; and electrically-operated actuating means for controlling passage of said stop mechanism from said locking position to said release position;

a slider, which is mounted so as to move, with respect to said support body, from a locking position, in which said slider is adapted to hold said catch in said retracted position, to a release position, in which said slider allows movement of said catch from said retracted position to said extracted position, due to an electrical excitation of said actuating means;

an elastic member tending to hold said slider in said locking position;

a cursor, which can be moved by said actuating means and is mounted so as to move, with respect to said support body, from an inactive position, in which said cursor allows the passage of said slider from said release position to said locking position due to the action of said elastic member, to an active position, in which drags said slider from said locking position to said release position against action of said elastic member, when said actuating means are electrically excited; and an elastic element, which holds said cursor in said inactive position.

* * * * *